United States Patent [19]

Fuscone

[11] Patent Number: 4,589,216

[45] Date of Patent: May 20, 1986

[54] SOLE ELEMENT

[76] Inventor: Roy Fuscone, 58 Grange Road, London W5, England

[21] Appl. No.: 610,661

[22] Filed: May 16, 1984

[30] Foreign Application Priority Data

May 18, 1983 [GB] United Kingdom ..... 8313779

[51] Int. Cl.[4] ..... A43B 13/00

[52] U.S. Cl. ..... 36/32 R; 36/25 R

[58] Field of Search ..... 36/88, 30 R, 43, 44, 36/32 R, 127, 91, 83; 128/81 R, 615, 617

[56] References Cited

U.S. PATENT DOCUMENTS

| | | | |
|---|---|---|---|
| 2,658,288 | 11/1953 | Scholl | 36/44 |
| 3,305,947 | 2/1967 | Kalsoy | 36/91 |
| 3,448,533 | 6/1969 | Beckwith | 36/30 R X |
| 3,457,659 | 7/1969 | Coleman | 36/44 |
| 3,472,508 | 10/1969 | Baker et al. | 36/83 X |
| 3,964,181 | 6/1976 | Holcombe, Jr. | 36/91 |
| 4,124,946 | 11/1978 | Tomlin | 36/30 R X |
| 4,259,792 | 4/1981 | Halberstadt | 36/32 R X |
| 4,425,721 | 1/1984 | Spronken | 36/88 X |

FOREIGN PATENT DOCUMENTS

| | | | |
|---|---|---|---|
| 565059 | 3/1958 | Belgium | 36/30 R |
| 1485680 | 9/1969 | Fed. Rep. of Germany | 36/30 R |
| 2610312 | 9/1976 | Fed. Rep. of Germany | 36/30 R |
| 2396524 | 3/1979 | France | 36/43 |

*Primary Examiner*—Werner H. Schroeder
*Assistant Examiner*—T. Graveline
*Attorney, Agent, or Firm*—Lalos, Keegan & Kaye

[57] ABSTRACT

A sole element (1) for a shoe, intended primarily for use when playing darts, includes a heel part which is thinner than the sole part. A raised bar (5) of generally arcuate shape is provided in that area of the sole part which underlies the base of the wearer's toes. The outer edge (3,4) of the sole element is preferably chamferred outwardly from its uppermost surface along each side of the sole element so that the floor contacting surface has a greater area than the upper surface. The chamfer angle is greater at the front of the sole element, generally forward of the raised bar (5), than at the rear.

26 Claims, 4 Drawing Figures

SOLE ELEMENT

This invention relates to footwear.

When playing darts, players correctly throw from behind a line or raised element which defines the minimum throwing distance. Many players take a stance with one foot in advance of the other and lean forward. Conventional footwear includes a flat or raised heel with the result that, in order to retain his or her balance, the player may exert substantial muscular effort, particularly in the leading leg and foot. If a player throws a dart with his or her feet side by side, the muscular effort involved may be even greater. The results of muscular strain are discomfort and poor balance and stability. These combine to produce movements detrimental to consistently accurate throwing which requires a firm and stable base; i.e. that the player attempts to stand still and throw with the throwing arm only. Physical discomfort also impairs concentration and leads to poor play as the interdependence of counting, throwing and composure is disturbed, and the combination of these factors into smooth and repeated accuracy made very difficult.

The present invention relates to an article of footwear, hereinafter call a shoe, intended for use primarily when playing darts.

According to the invention, in a sole element for a shoe the heel part is thinner than the sole part and a raised portion of substantially arcuate shape is provided in that area of the sole part which underlies the base of the wearer's toes.

Preferably also the sole element has an outer edge which is chamferred outwardly from its uppermost suface along each side of the sole element between the toe and heel ends so that the floor contacting surface has a greater area than the upper surface. In general the chamfer angle is not constant from heel to toe, edges of the sole element being more steeply inclined to the floor contacting surface between the toe and the position of the ball of the foot, and less steeply inclined from the position of the ball of the foot towards the heel. Suitable angles of chamfers are 80° and 45° respectively. The chamfers provide increased stability for the wearer particularly when the foot is placed at an angle to the direction of throwing, and when, after wear the upper of a shoe embodying the sole element sags outwardly beyond the welt as is often the case particularly when the upper is made of fabric.

The transition between the two chamferred parts on each side of the sole element is preferably defined by a line. The extreme ends of the sole element at the toe a and heel are desirably formed straight across the line of the foot, and the sole element edges at these parts is preferably substantially perpendicular to the floor contacting surface, i.e. the toe and heel are cut square.

The raised arcuate bar portion can be formed by suitably moulding a one-piece sole element. Alternatively it can be provided on a separate insole placed above the sole element and be moulded integrally with the insole or formed separately and subsequently attached to the under surface of the insole. The thickness and width of the bar should be chosen to provide a raised area which lies comfortably beneath the bases of the wearer's toes to provide a "grip" for the toes when a dart is thrown by the wearer. In general the width is not constant and is at a maximum approximately one third across the sole from the inside of the foot and at a minimum at the outside of the foot.

For optimum performance the difference in thickness of the sole between toe and heel should be determined by the stature of the wearer and his or her foot size. However for all practical purposes the same difference will be satisfactory for all shoe sizes. A preferred thickness at the heel is 12.5 mm and at the toe 25 mm, and the relationship of the thickness at the heel to that at the toe should preferably not exceed 1:2. The sole element should be preferably of uniform thickness from the heel forward to the area which supports the ball of the foot and increase uniformly from that area to the extremity of the toe so that the toe portion presents an inclined plane along its upper surface extending upwardly from the position of the bar portion. The sole element, and the insole if separate, therefrom, is conveniently moulded from a suitable rubber or plastics composition.

For a clearer understanding of the invention, an exemplifying embodiment will now be described with reference to the accompanying drawings, in which.

Figure 4:
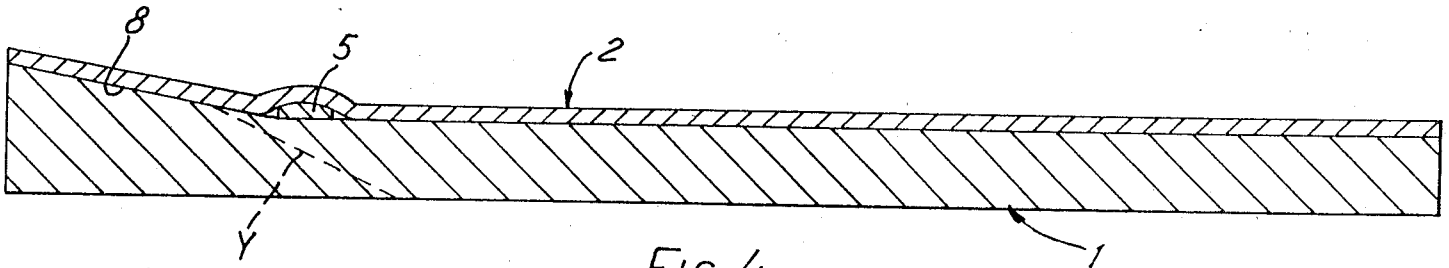
FIG. 4 shows a longitudinal section of the sole element of FIG. 3.
Figure 3:
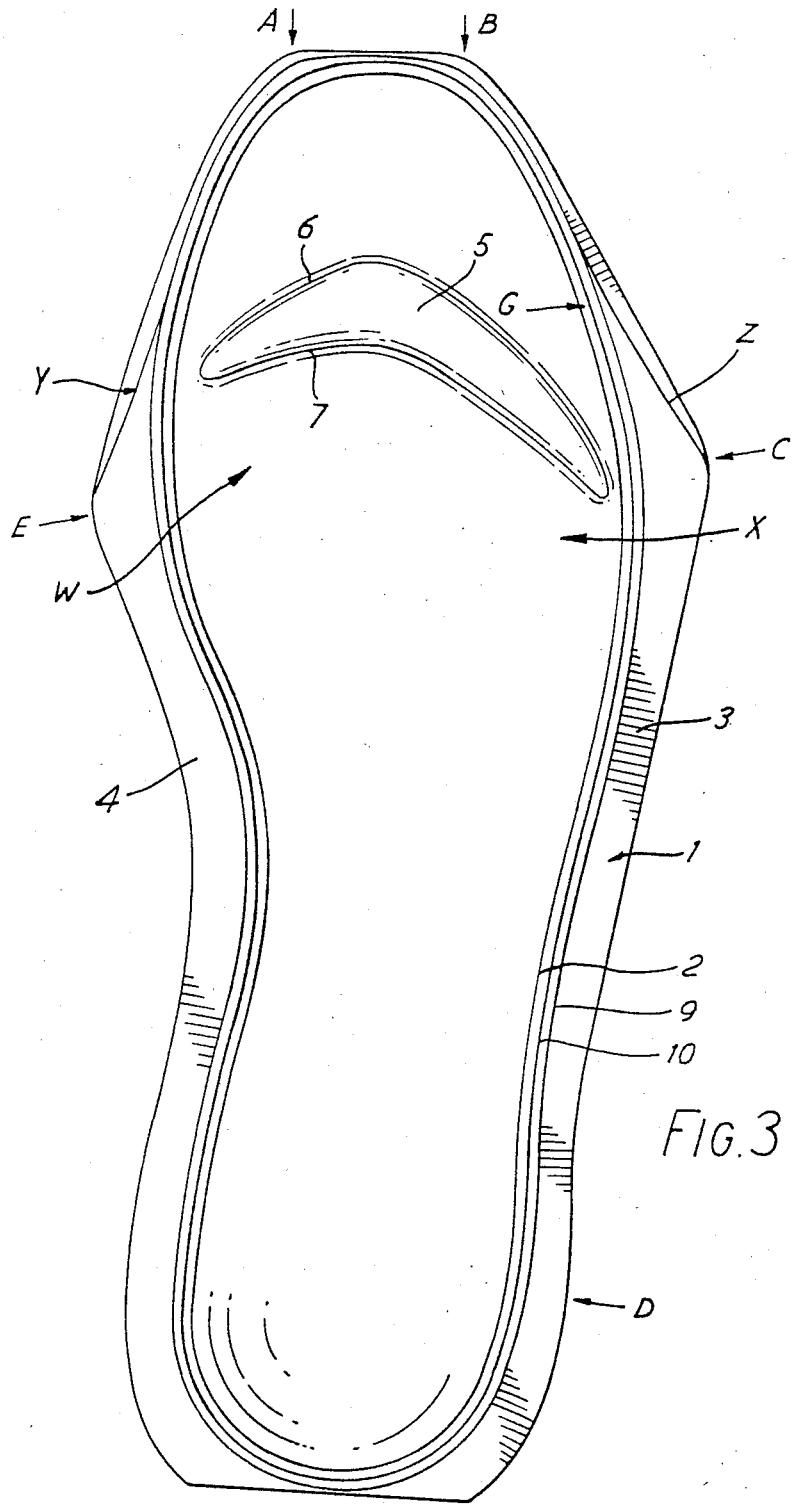
FIG. 3 shows a plan view of a sole element according to an alternate embodiment of the invention.

The sole element comprises a main outsole 1 which forms a combined sole and heel structure and an insole 2. The outsole 1 has a flat ground contacting or bottom surface which is generally wider over the whole of the length of the sole element than the upper surface so that the edges 3, 4 are chamferred to incline upwardly and inwardly. The upper surface presents the conventional foot supporting shape being narrowed at the instep and of greatest breadth in the area of the ball of the foot C-E. From the points C and E to the heel, the sole edges are inclined at 45° to the bottom surface and forwardly from these points to the toe line chamfer angle is 80°. The points C and E lie respectively in front of X and behind W, the line W-X being the position of the proximal tarsal joints of a wearer of the sole element. The lines Y and Z define a transition between the two chamfers. Between points A and B the sole edge is vertical and cut transversely to the line of the foot to form a square toe. The bottom of the sole element at the heel may be rounded as shown but is preferably cut square and may be chamfered as shown or have a vertical edge at the centre. These variations are illustrated in FIGS. 3 and 4.

Figure 1:
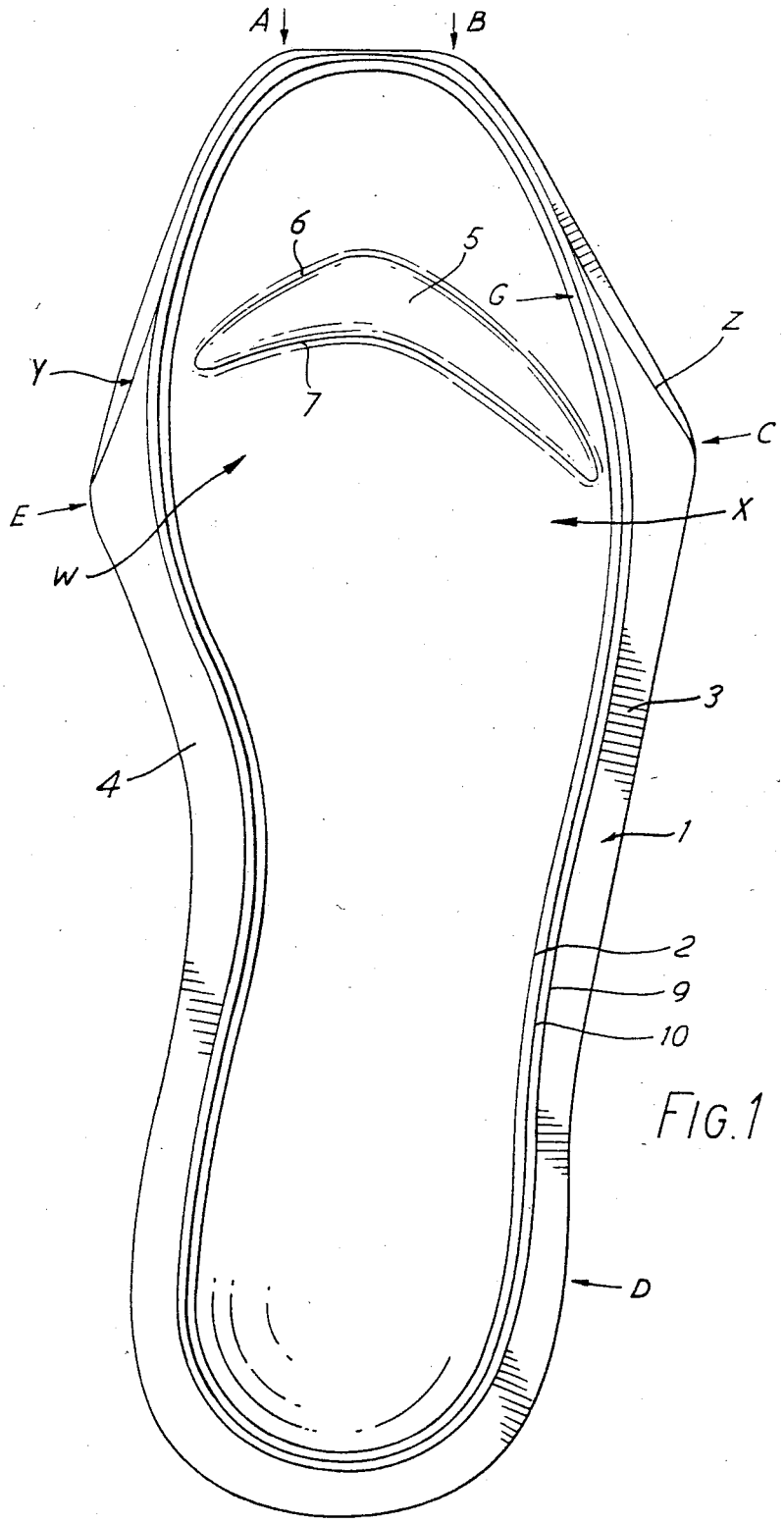
FIG. 1 shows a plan view of a sole element according to the invention.
Figure 2:
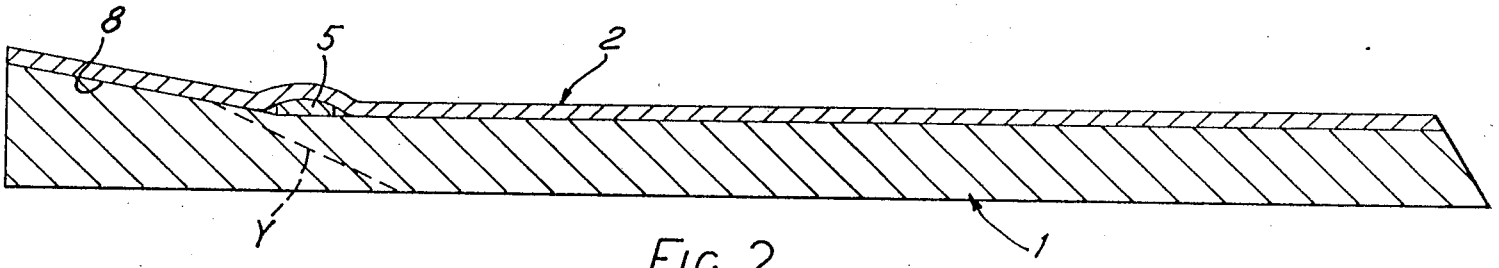
FIG. 2 shows a longitudinal section of the sole element of FIG. 1 without the upper and welt.

The insole has a peripheral outline which runs parallel with the edge of the upper surface of the outsole as shown. In the area which lies under the proximal tarsal region it is provided on its underside with a generally arcuate bar 5. The arcuate edges 6, 7 of the bar are not of constant curvature so that the bar is of a boomerang shape with a widest part lying beneath the base of the second toe and tapering towards the inside and outside edges of the sole. As shown in FIG. 2, the bar is a separate member fixed to the insole, but if desired it can be fixed to the outsole or moulded in one piece with the insole or the outsole.

As best seen in FIG. 2 the thickness of the outsole is not constant between the heel and the toe of the foot. From the heel forwardly it is substantially constant up to the area of the ball of the foot and then increases uniformly to the toe to form an inclined plane 8 on which the toes rest. Although not shown in the drawings, it is preferred to provide a shallow depression in the upper surface of the outsole to cushion the base of the wearer's heel in conventional manner.

The insole may merely rest on the outsole and/or be secured thereto by adhesive of other convenient means. In an alternative construction, the insole with the bar and the outsole may be formed by a single unitary moulding.

The shoe is preferably constructed to include a welt 9, between the upper 10, and the outsole 1 and the uppermost edges of the chamferred areas 3 and 4 abutt the edge of the welt. Although a welt is not necessary to the construction of the shoe, the inclusion thereof is desirable in assisting rigidity and therefore wearer stability.

A shoe embodying the sole element may be provided with any preferred form of upper of canvas, leather, plastics or other preferred material, and the upper can be attached to the welt area on the outside by adhesive, heat sealing or other known means.

What is claimed is:

1. A sole element for a shoe, the sole element comprising a heel part and a front sole part, the thickness of the heel part being uniform, the thickness of the front sole part increasing from a position corresponding to the ball of the wearer's foot to the toe end of the front sole part, the front sole part having a raised portion of substantially arcuate shape provided in the area of the front sole part which underlies the base of the wearer's toes.

2. A sole element according to claim 1, wherein the sole element has an outer edge which is chamferred outwardly from its uppermost surface along each side of the sole element between toe and heels ends thereof, whereby the area of the floor contacting surface is greater than that of the upper surface.

3. A sole element according to claim 2, wherein the floor contacting surface is flat.

4. A sole element according to claim 2, wherein the outer edge of the sole element has a first chamfer angle along a first portion between the toe and a position corresponding to the ball of the wearer's foot, and a second chamfer angle along a second portion of the outer edge between the position corresponding to the ball of the wearer's foot and the heel of the sole element.

5. A sole element according to claim 4, wherein the second chamfer angle is less than the first chamfer angle.

6. A sole element according to claim 5, wherein the first chamfer angle is about 80° and the second chamfer angle is about 45°.

7. A sole element according to claim 4, wherein the transition between the two chamfered portions on each side of the sole element is defined by a generally diagonal line.

8. A sole element according to claim 1, wherein the front sole part has a greatest breadth defined by inner and outer extreme portions, the inner extreme portion being behind a position corresponding to the inner proximal tarsal joint of the wearer's foot, and the outer extreme portion being in front of a position corresponding to the outer proximal tarsal joint of the wearer's foot.

9. A sole element according to claim 1, wherein the extreme end of the sole element at the toe is defined by a straight line generally perpendicular to the longitudinal axis of the sole element.

10. A sole element according to claim 9, wherein the extreme end at the toe is substantially perpendicular to the floor contacting surface.

11. A sole element according to claim 1, wherein the extreme end of the sole element at the heel is defined by a straight line generally perpendicular to the line of the foot.

12. A sole element according to claim 11, wherein the extreme end at the heel is substantially perpendicular to the floor contacting surface.

13. A sole element according to claim 1, wherein the raised portion of the front sole part is in the form of a generally arcuate bar each of whose edges is of varying curvature.

14. A sole element according to claim 13, wherein the bar has its widest part corresponding to the position of the base of the wearer's second toe, the width of the bar tapering towards each side of the sole element.

15. A sole element according to claim 1, wherein the raised portion is provided on a separate insole placed above a base portion of the sole element.

16. A sole element according to claim 15, wherein the raised portion is separate from the insole.

17. A sole element according to claim 1, wherein the ratio between the thicknesses of the heel part and the toe end of the front sole part does not exceed 1:2.

18. A sole element according to claim 17, wherein the thicknesses of the heel part and the toe end of the front sole part are 12.5 mm and 25 mm respectively.

19. A sole element according to claim 1, wherein the increase in thickness to the toe end is uniform so that the toe portion presents an inclined plane along its upper surface extending upwardly from the position of the raised portion.

20. A sole element according to claim 1, wherein the outside edge of the sole element between the toe end and a position proximate to the outside end of the raised portion is defined by a straight line at an angle to the longitudinal axis of the sole element.

21. A sole element according to claim 1, wherein the outside edge of the sole element between a position proximate to the outside end of the raised portion and a position intermediate that position and the heel end is defined by a straight line diverging from the line of the foot.

22. A sole element according to claim 1, including a welt around the periphery of the top surface of the sole element for attachment of an upper thereto.

23. A sole element for a shoe, the sole element comprising a heel part and a front sole part, the front sole part having a raised portion of substantially arcuate shape provided in the area of the front sole part which underlies the base of the wearer's toes, the sole element having an outer edge which is chamferred outwardly from its uppermost surface along each side of the sole element between toe and heel ends thereof whereby the area of the floor contacting surface is greater than that of the upper surface, wherein the outer edge of the sole element has a first chamfer angle along a first portion between the toe and a position corresponding to the ball of the wearer's foot, and a second chamfer angle along a second portion of the outer edge between the position corresponding to the ball of the wearer's foot and the heel of the sole element, and wherein the second chamfer angle is less than the first chamfer angle.

24. A sole element according to claim 23, wherein the floor contacting surface is flat.

25. A sole element according to claim 23, wherein the first chamfer angle is about 80° and the second chamfer angle is about 45°.

26. A sole element according to claim 23, wherein the transition between the two chamfered portions on each side of the sole element is defined by a generjally diagonal line.

* * * * *